United States Patent [19]

Appel et al.

[11] Patent Number: 4,535,830

[45] Date of Patent: Aug. 20, 1985

[54] LATERAL-TRACTION ROLLER SHADE

[75] Inventors: Hans Appel, Bremen; Hermann Heidenescher, Melle, both of Fed. Rep. of Germany

[73] Assignee: Zundwarenfabrik Stracke GmbH & Co., Melle, Fed. Rep. of Germany

[21] Appl. No.: 528,019

[22] Filed: Aug. 31, 1983

[30] Foreign Application Priority Data

Sep. 3, 1982 [DE] Fed. Rep. of Germany ..... 3232722

[51] Int. Cl.[3] ..... E06B 9/208

[52] U.S. Cl. ..... 160/299

[58] Field of Search ..... 160/1, 298, 299, 305, 160/307, 308

[56] References Cited

U.S. PATENT DOCUMENTS 1,783,002 11/1930 Simpson ..... 160/299

4,161,204 7/1979 Kurz ..... 160/1

4,424,851 1/1984 Kohayakawa ..... 160/298

*Primary Examiner*—Peter M. Caun

*Attorney, Agent, or Firm*—Sprung Horn Kramer & Woods

[57] ABSTRACT

One end of the retraction spring of a lateral-traction roller shade is fastened to an interior rod that is stationary once it has been installed. The other end of the spring is fastened to a carrier bushing that rotates on the interior rod. The shaft of the shade is attached to the bushing and one end of a retention and clamping spring that surrounds the rod is fastened inside the bushing in such a way that the spring will rotate along with it. The other end of the spring is positioned in the path traveled by a drive segment on a sheave when the shade is lowered and in front of a drive rib on the bushing that is also positioned in the path. The raising of the shade is thus facilitated by the retraction spring.

8 Claims, 2 Drawing Figures

4
3
9
12
5
6
16
8
11a
7
II
11
19
10
1
14
2
17
13
15
II
14
4
17

13a
13
3
6
9
16
15
8
14
17
H
A

LATERAL-TRACTION ROLLER SHADE

BACKGROUND OF THE INVENTION

The present invention concerns a lateral-traction roller shade with a lateral sheave in driving relation to a roller-shade shaft and with a resiliently active device that retains and clamps the shaft and that can be released by the sheave.

In known lateral-traction roller shades of this type, a bead chain is positioned around the sheave in such a way that the shade can be rolled up or down through the sheave by pulling on one cord or the other. Although the extent to which the shade can be pulled down can be adjusted continuously and although the shade is easy to operate from the side, it can be raised only by muscle power, which can be very exhausting if the shade is large.

Roller shades that can be centrally activated, by pulling a cord attached to a catch rod, are known. These known shades have a retraction spring that rewinds them, the retraction spring being mounted on a stationary interior rod. They also have ratchet locking devices. The length to which they can be pulled down cannot be continuously adjusted and the central activating cord can be blocked by curtains, flower pots, window seats, etc.

SUMMARY OF THE INVENTION

The object of the present invention is to provide a lateral-traction roller shade of the aforesaid generic type, in which the known advantages are retained but that is considerably easier to raise even though its design is simple and it will take up little space.

This objective is achieved in accordance with the invention wherein one end of a retraction spring is attached to a stationary interior rod and its other end to a carrier bushing that rotates on, but cannot be displaced along, the rod, wherein the shaft of the shade is attached to the bushing, and wherein the end of a retention and clamping spring around the interior rod that points away from the sheave is secured in the bushing in such a way as to rotate along with it while its other end is positioned in the unwinding path of a drive segment at the sheave but in front of a drive rib, which is also in the path, on the bushing.

If the sheave in this design is activated in the unwinding direction, the drive segment will initially release the retention and clamping spring from the stationary interior rod and then, upon encountering the drive rib on the carrier bushing, force the shade in the unwinding direction over the bushing. Whenever the unwinding traction is discontinued the shaft of the shade will immediately stop rotating because the retention and clamping spring will close around the interior rod again and block the carrier bushing.

If the drive rib is activated in the raising direction by pulling on the appropriate string, the drive segment will encounter the other side of the drive rib in the carrier bushing, which will rotate, releasing the end of the retention and clamping spring that is secured in it in such a way as to rotate along with it, and the retraction spring, which was tensioned when the shade was pulled down, will now apply force in a direction that promotes raising the shade, so that the manual force that must be exploited will be considerably reduced. If traction force is discontinued while the shade is being raised, the spring will also tension itself tightly around the interior rod so that the shade will again be retained in its instantaneous position.

This design, involving integration of the stationary interior rod and retraction spring into the lateral-traction roller-shade mechanism is, however, extremely simple as well as being compact and small in relation to its demands. The core of the design is the carrier bushing with its extraordinary multiplicity of function. It not only accommodates and to some extent controls the retention and clamping spring but also accepts the operating forces of the sheave and transfers them to the shaft, simultaneously tensioning the retraction spring when the shade is pulled down and introducing auxiliary force from the spring when the shade is raised. It is also a mount and bearing for the shaft of the shade.

Another preferred embodiment of the object of the invention includes the provision of a pin on the end of the carrier bushing toward the sheave, with the end of the retraction spring attached thereto. Further, two parallel and separate ribs are preferably provided in the rear accommodation space that faces away from the sheave inside the carrier bushing, with the bent, corresponding end of the retention and clamping spring positioned between the ribs in such a way that the spring rotates along with the bushing.

In a further preferred embodiment, the shaft is secured on the outside of the carrier bushing against a flange on one end of the bushing. Additionally, the end of the carrier bushing toward the sheave is preferably mounted in an annular seating space in the sheave. The axially outer end of the sheave is preferably supported on the housing and the carrier bushing on the sheave and the other end of the carrier bushing is preferably secured against axial displacement along the interior rod by means of a securing sleeve. A sleeve of antifriction material is preferably provided at least in the vicinity of the retention and clamping spring on the interior rod, with the spring tensioned around the sleeve. The sleeve preferably extends outward beyond the interior rod with the housing supported centrally inside the sleeve by means of a pin, and with the sheave mounted on the sleeve in the vicinity of the pin in such a way as to rotate.

One embodiment of this type of lateral-traction roller shade will now be described with reference to the drawings, in which:

DETAILED DESCRIPTION OF THE INVENTION

Figure 1:
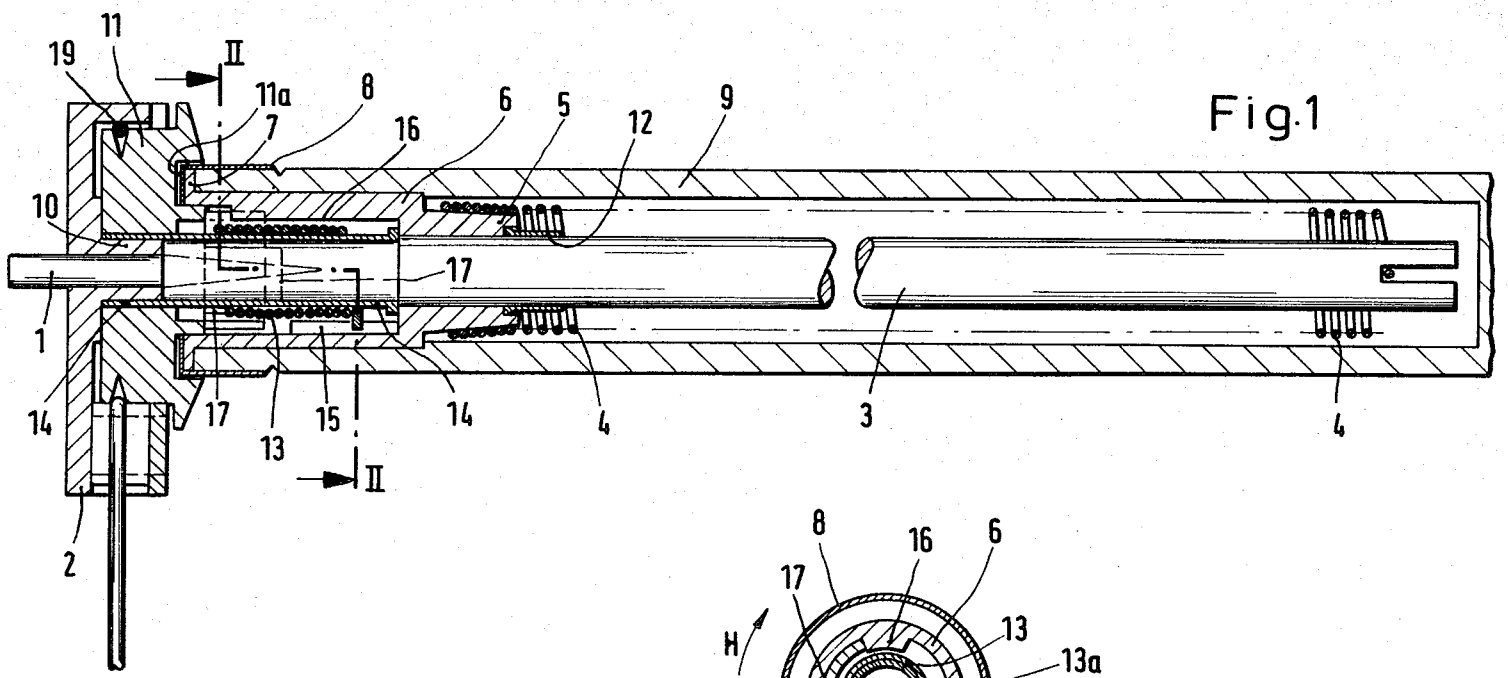
FIG. 1 is a longitudinal section through a lateral-traction shade in accordance with the invention.
Figure 2:
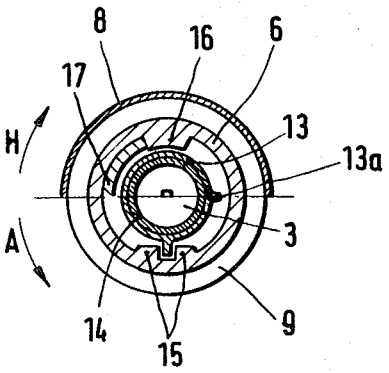
FIG. 2 is a section along line II—II in FIG. 1.

Referring now to FIGS. 1 and 2, a four-sided piece 1 is inserted through a four-sided hole in a lateral housing 2, which secures the lateral-traction roller shade at the end to a building, into an interior rod 3 securing it in place and preventing it from rotating. A retraction spring 4 is mounted on interior rod 3. One end of spring 4 is secured in the free end of interior rod 3 and its other end is attached to a pin 5 on a carrier bushing 6. Bushing 6 can rotate on interior rod 3.

The shaft 9 of the shade is attached to the outside of carrier bushing 6 through a flange 7 at the end of the bushing and through a clamp 8. Thus, shaft 9 accommodates carrier bushing 6, retraction spring 4, and interior rod 3.

A sheave 11 is also mounted in lateral housing 2 by means of a hub 10. A closed loop of cord or chain 19 is positioned around sheave 11 and rotates it when the shade is raised or lowered. In the embodiment illustrated, the area around the flange 7 on carrier bushing 6 engages an appropriate annular recess 11*a* in sheave 11, providing satisfactory protection especially for the mounting of the parts inside carrier bushing 6, which have yet to be described in detail. Carrier bushing 6 and sheave 11 are secured against displacement along the axis of the shade because one side of sheave 11 can rest on housing 2, whereas carrier bushing 6 is secured at its pin 5, which accepts retraction spring 4, by a securing sleeve 12 attached to interior rod 3.

A retention and clamping spring 13 also surrounds interior rod 3 inside carrier bushing 6. The resilience of spring 13 can tension it around and secure interior rod 3. It is also practical for a sleeve 14 of antifriction material to be slipped over interior rod 3 to protect it against wear, in which case retention and clamping spring 13 can be tensioned around the sleeve. Sheave 11 is mounted on sleeve 14. The sleeve also overlaps both interior rod 3 and the pin 10 on housing 2, helping to secure the rod precisely in place.

Two separate ribs 15 are integrated into the rear, which faces away from sheave 11, of the inside of carrier bushing 6. The rear, bent end of retention and clamping spring 13 is inserted into these ribs in such a way as to rotate along with them. Opposite the two ribs 15, a drive rib 16 that extends into the vicinity of the front is also integrated into carrier bushing 6. Drive rib 16, however, still leaves space free for the forward, hooked end 13*a* of retention and clamping spring 13 in the forward part, facing sheave 11, of carrier bushing 6. A drive segment 17 that projects into carrier bushing 6 is also integrated into sheave 11. Drive rib 16 extends into the path of drive segment 17, into which the bent, forward end 13*a* of retention and clamping spring 13 also extends, as will be described in the following. Ribs 15, however, are positioned outside the path of drive segment 17.

When sheave 11 is rotated in the direction indicated by arrow A in FIG. 2, in which the shade is lowered, by traction applied to the appropriate length of cord or chain 19, drive segment 17 will initially encounter the forward, bent end 13*a* of retention and clamping spring 13, which is positioned first along the path in the unrolling direction (see FIG. 2). Spring 13 is accordingly released in opposition to its spring force so that, as rotation is continued in the direction in which the shade is lowered and drive segment 17 encounters the corresponding side of drive rib 16, carrier bushing 6 will be able to rotate unobstructed around interior rod 3. The shaft 9 of the shade will be entrained by the bushing, the shade will be lowered, and retraction spring 4 will be simultaneously tensioned. If traction is discontinued during this lowering motion, the torque on sheave 11 will cease, retention and clamping spring 13 will be able to tension around interior rod 3 or sleeve 14, blocking carrier bushing 6 and hence shaft 9 as the result of its entrainment. The shade will always remain precisely in the position at which traction is discontinued.

The shade can be raised by pulling the other appropriate cord or chain 19 to rotate sheave 11 in the raising direction indicated by arrow H in FIG. 2.

Drive segment 17 will now, without affecting retention and clamping spring 13 in any way, encounter the other side of the drive rib 16 on carrier bushing 6. Carrier bushing 6 will entrain through ribs 15 the bent, rear end of retention and clamping spring 13, which will again be released. The rotation of carrier bushing 6 in the raising direction will now be promoted by the retractive force of retraction spring 4, which was tensioned while the shade was being lowered, and the shade can be raised with very little effort. If the torque on sheave 11 ceases while the shade is being raised, retention and clamping spring 13 will immediately tension itself again around interior rod 3 due to its own resiliency and the shade will again immediately remain in position.

The drive mechanisms described can of course be mounted without difficult on either the right or the left end of shade shaft 9, the only difference being the direction in which the springs are coiled.

It will be appreciated that the instant specification and claims are set forth by way of illustration and not limitation, and that various modifications and changes may be made without departing from the spirit and scope of the present invention.

What is claimed is:

1. In a lateral-traction roller shade having a housing, a lateral sheave rotatably mounted in the housing, means effecting a driving relation between the sheave and a tubular roller-shade shaft and resiliently active means for retaining the shaft in position relative to the housing and which is releasable in response to the rotation of the sheave, the improvement comprising: a rod disposed in the interior of the shaft and fixed at one end to the housing; wherein the means effective a driving relation between the sheave and the shaft comprises a bushing mounted around the rod and within the shaft for rotation relative to the rod without any longitudinal displacement and fixed to the sheave and the shaft, the bushing including means forming an annular compartment around a portion of the rod; a retracting spring disposed around the rod and fixed at one end to the rod; means connecting the other end of the retraction spring to the bushing thereby functionally connecting the shaft to the retracting spring; wherein the retaining means includes a retaining spring disposed around the rod and in the annular compartment, means connecting the one end of the retaining spring furthest from the sheave to the bushing to effect rotation of the retaining spring with the bushing and wherein the other end projects outwardly and is movable in a given circular path, a drive segment connected to the sheave and disposed in the given path of the other end of the retaining spring and a drive member fixed on the bushing and in said given path downstream of the other end in the unwinding direction.

2. The shade as in claim 1, wherein the means connecting the retraction spring to the bushing comprises a pin on the end of the bushing furthest from the sheave and to which the end of the retraction spring is attached.

3. The shade as in claim 1, wherein the means connecting said one end of the retaining spring to the bushing comprises two parallel and spaced apart ribs in the annular compartment at the end thereof furthest from the the sheave, with said one end of the retaining spring positioned between the ribs such that the retaining spring rotates along with the bushing.

4. The shade as in claim 1, wherein the bushing has a flange on one end thereof and the shaft is secured to the bushing against the flange.

5. The shade as in claim 1, wherein the sheave has an annular seating space and the end of the carrier bushing facing toward the sheave is mounted in the annular seating space in the sheave.

6. The shade as in claim 1, wherein the sheave has an axially outer end supported on the housing and wherein the bushing is supported the sheave at one end and wherein the other end of the bushing has means preventing axial displacement along the interior rod comprising a securing sleeve.

7. The shade as in claim 1, further comprising a sleeve of antifriction material on the rod at least in the vicinity of the retaining spring with the retaining spring tensioned around the sleeve.

8. The shade as in claim 7, wherein the sleeve extends outward beyond the interior rod, wherein the housing has a first portion is supported centrally within the sleeve and wherein the sheave is mounted for rotation on the sleeve in the vicinity of the first portion of the housing.

* * * * *